US005173736A

United States Patent [19]

Cherian

[11] Patent Number: 5,173,736

[45] Date of Patent: Dec. 22, 1992

[54] APPARATUS AND METHOD FOR FUSING MARKING PARTICLES ONTO A SUPPORT MEMBER

[75] Inventor: Abraham Cherian, Webster, N.Y.

[73] Assignee: Xerox Corporation, Stamford, Conn.

[21] Appl. No.: 755,933

[22] Filed: Sep. 6, 1991

[51] Int. Cl.[5] ..... G03G 15/20

[52] U.S. Cl. ..... 355/285; 355/282

[58] Field of Search ..... 355/282, 285, 289, 290, 355/295; 219/216, 469, 243, 244, 388; 430/99

[56] References Cited

U.S. PATENT DOCUMENTS

| | | | |
|---|---|---|---|
| 3,437,032 | 4/1969 | Manghirmalani et al. | 100/93 |
| 4,348,579 | 9/1982 | Namba | 219/216 |
| 4,538,052 | 8/1985 | Asanuma et al. | 219/469 |
| 4,618,240 | 10/1986 | Sakurai et al. | 355/290 |
| 4,724,305 | 2/1988 | Iimura et al. | 219/469 |
| 4,736,226 | 4/1988 | Mogi | 355/290 |
| 4,888,464 | 12/1989 | Shibata et al. | 219/216 |
| 5,047,809 | 9/1991 | Owada et al. | 219/216 X |

FOREIGN PATENT DOCUMENTS 57-189170 11/1982 Japan .

*Primary Examiner*—A. T. Grimley
*Assistant Examiner*—Sandra L. Brasé
*Attorney, Agent, or Firm*—Gary B. Cohen

[57] ABSTRACT

An apparatus is provided for fusing marking particles onto a support member. One preferred embodiment of the fusing apparatus includes a journal member, the journal member including a shaft and a base with the shaft and the base being coupled. The fuser apparatus further includes a roller member having opposing ends, the roller member defining a shoulder near an end of the roller member. A retaining member is provided for retaining the base adjacent the shoulder so that at least a portion of the base is in substantial contact with the shoulder. Additionally, a heating device is provided to fuse the marking particles onto the support member when the support member with marking particles is brought into contact with the rolling member.

30 Claims, 4 Drawing Sheets

APPARATUS AND METHOD FOR FUSING MARKING PARTICLES ONTO A SUPPORT MEMBER

BACKGROUND AND MATERIAL DISCLOSURE STATEMENT

1. Field of the Invention

The present invention relates generally to a fuser apparatus for a printing machine and more specifically to a fuser roll in which a journal member is secured simply and effectively to a roller or tubular member.

2. Description of the Prior Art

In imaging systems commonly used today, a charge retentive surface is charged to a uniform potential and thereafter exposed to a light source for selectively discharging the charge retentive surface to form a latent electrostatic image thereon. The image may comprise either the discharged portions or the charged portions of the charge retentive surface. The light source may comprise any well known device such as a light lens scanning system or a laser beam. Subsequently, the electrostatic latent image on the charge retentive surface is rendered visible by developing the image with developer powder referred to in the art as toner. The most common development systems employ developer which comprises both charged carrier particles and charged toner particles which triboelectrically adhere to the carrier particles. During development, the toner particles are attracted from the carrier particles by the charged pattern of the image areas of the charge retentive surface to form a powder image thereon. This toner image may be subsequently transferred to a support surface, such as plain paper, to which it may be permanently affixed by heating and/or applying pressure.

In order to fix or fuse the toner material onto a support member with heat, the temperature of the toner material is elevated to a point at which constituents of the toner material coalesce and become tacky. This heating causes the toner to flow to some extent onto the fibers or pores of the support members or otherwise upon the surfaces thereof. Thereafter, as the toner material cools, solidification of the toner material occurs causing the toner material to be bonded firmly to the support member.

One approach to thermal fusing of toner material images onto the supporting substrate has been to pass the substrate with the unfused toner images thereon between a pair of opposed roller members, at least one of which is internally heated. During operation of a fusing system of this type, the support member, to which the toner images are electrostatically adhered, is moved through a nip formed between the rolls with the toner image contacting the heated fuser roll to thereby effect heating of the toner images within the nip. Typically, at least one of the roller members, such as the internally heated roller member, has endcaps fitted to the opposing ends thereof. Each endcap preferably includes a shaft, the shaft being rotatably mounted to a bearing member.

In one known embodiment of a fuser roller, the roller member and the endcaps are constructed from a similar conductive material, such as aluminum. Indeed, in one example the roller member and the endcaps are cast as a single piece. It has been found, however, that using the same material to construct both the roller member and the endcaps is disadvantagious. In particular, when the same material is used to construct the fuser roller, the heat distribution is the same across the entire fuser roller so that, during the fusing process, the heat dissipation is the same for the roller member and the endcaps. This is undesirable since, under ideal conditions, a relatively high level of heat is dissipated by the roller member, to facilitate fusing, and a relatively low level of heat is dissipated by the endcaps, to minimize wear on the bearing member. Various disclosures of fusing apparatuses, capable of reducing heat dissipation in the endcaps, are briefly summarized below:

U.S. Pat. No. 3,437,032
Patentee: Manghirmalani et al.
Issued: Apr. 8, 1969
U.S. Pat. No. 4,538,052
Patentee: Asanuma et al.
Issued: Aug. 27, 1985
U.S. Pat. No. 4,618,240
Patentee: Sakurai et al.
Issued: Oct. 21, 1986
Japanese Application No. 56-73514
Application Filing Date: May 18, 1981
Japanese Publication No. 57-189170
Publication Date: Nov. 20, 1982
Inventor: Itou U.S. Pat. No. 4,538,052 discloses a "prior art" fuser roller and an improvement thereof. The known fuser roller comprises an aluminum roller member with stainless steel endcaps. Preferably the endcaps are fitted to the aluminum roller member under pressure using frictional heat. U.S. Pat. No. 3,437,032 discloses a fuser roll which is similar to the above-mentioned prior art fuser roll in that stainless steel endcaps are shown secured to the ends of a nickel-plated copper tube. To avoid the technical difficulties in securing stainless steel to another metal, as well as the relatively high manufacturing costs associated with such securing, U.S. Pat. No. 4,538,052 discloses an improved fuser roller in which a pair of bearings, having outer races made of heat-resistant resin, are fitted into end portions of the aluminum cylinder under pressure to support the cylinder so that the outer races and cylinder turn as one unit. The heat-resistant resins are more economical than the metal members, and the races can easily be fit into both end portions of the aluminum cylinder by merely pressing them against both end portions of the cylinder.

U.S. Pat. No. 4,618,240 discloses a fuser roller having a roller with shafts at the end thereof. The shafts are rotatably mounted in bearings and are fitted with heat resistive sleeves. The heat resistive sleeves are constructed of heat-intercepting material and disposed between the shafts and bearings to prevent heat transfer between the ends of the roller and the bearings.

Japanese application No. 57-189170 discloses a heater roller made of thin cylinders. A roller rotation driving member is fitted to both ends of the thin cylinders via elastic members, such as silicon rubber members, to reduce heat loss from the thin cylinders through the shaft.

While the fuser rolls of U.S. Pat. No. 4,538,052 and Japanese application No. 57-189170 may effectively isolate a roller member from a journal, these fuser rolls are not necessarily easy to construct since the endcap components must be pressed or forced into end portions of the roller member. In particular, manufacturing costs for these rolls can be needlessly high since special tooling is required to achieve the pressing or forcing. Moreover, while both the prior art fuser roll of U.S. Pat. No.

4,538,052 and the fuser roll of U.S. Pat. No. 3,437,032 possess designs that are simple and durable, they too can be needlessly expensive to manufacture since fitting an endcap of one material to a roller of another material can be technically difficult. It would be desirable to provide a fuser roller that is both cheap and easy to manufacture as well as simple and durable in design.

SUMMARY OF THE INVENTION

In accordance with the present invention an apparatus for fusing marking particles onto a support member is provided. A first preferred embodiment of the fusing apparatus includes a journal member, the journal member including a shaft and a base with the shaft and the base being coupled. The fuser apparatus further includes a roller member having opposing ends, the roller member having means for supporting the journal member near an end of the roller member. Means for retaining the base is provided for retaining the base adjacent the supporting means so that at least a portion of the base is in substantial contact with the supporting means. Additionally, means for heating the roller member is provided to fuse the marking particles onto the support member when the support member with marking particles is brought into contact with the rolling member.

In one aspect of the disclosed first embodiment, the roller member comprises a hollow cylindrical tube having opposing open ends and the supporting means is defined by a shoulder formed along an inner wall of the cylinder. Additionally, the journal member and the hollow cylindrical tube form a cavity therebetween while a metal plug is disposed in the cavity.

In yet another aspect of the disclosed first embodiment, each of the shaft and the roller member is thermally conductive, and the thermal conductivity of the shaft is substantially less than the thermal conductivity of the roller member.

A second embodiment of the fusing apparatus includes a tubular member having opposing ends and comprising a first material. The fusing apparatus further includes a journal member, the journal member including a shaft and a base with the shaft and the base being coupled. The shaft comprises a second material and the base comprises at least a quantity of the first material along an outer periphery thereof. Means for securing the outer periphery of the base to an inner surface of the tubular member is provided so that a secure bond can be formed between the first material of the inner surface of the tubular member and the first material of the periphery of the base. Additionally, means for heating the tubular member is provided to fuse the marking particles onto the support member when the support member with marking particles is brought into contact with the tubular member.

In one aspect of the disclosed second embodiment, the periphery of the base is welded to an inner surface of the tubular member. In yet another aspect of the disclosed second embodiment, each of the shaft and the tubular member is thermally conductive, and the thermal conductivity of the shaft is substantially less than the thermal conductivity of the tubular member.

Numerous features will be appreciated by those skilled in the art. First, the fuser roll is easy to manufacture and therefore has relatively low manufacturing costs. Second, the bond between the journal member and the roller member is particularly durable so that the fuser roller life is maximized. In the preferred embodiments of the present invention, the journal member can be tightly secured without forcing or pressing the journal member into the roller member. Finally, when the journal member is constructed of less conductive material than the roller member, less heat is dissipated near the fuser roller ends. Accordingly, bearings, in which the ends are commonly mounted, are unlikely to be overheated.

These and other aspects of the invention will become apparent from the following description, the description being used to illustrate a preferred embodiment of the invention when read in conjunction with the accompanying drawings.

DESCRIPTION OF A PREFERRED EMBODIMENTS OF THE INVENTION

Figure 1:
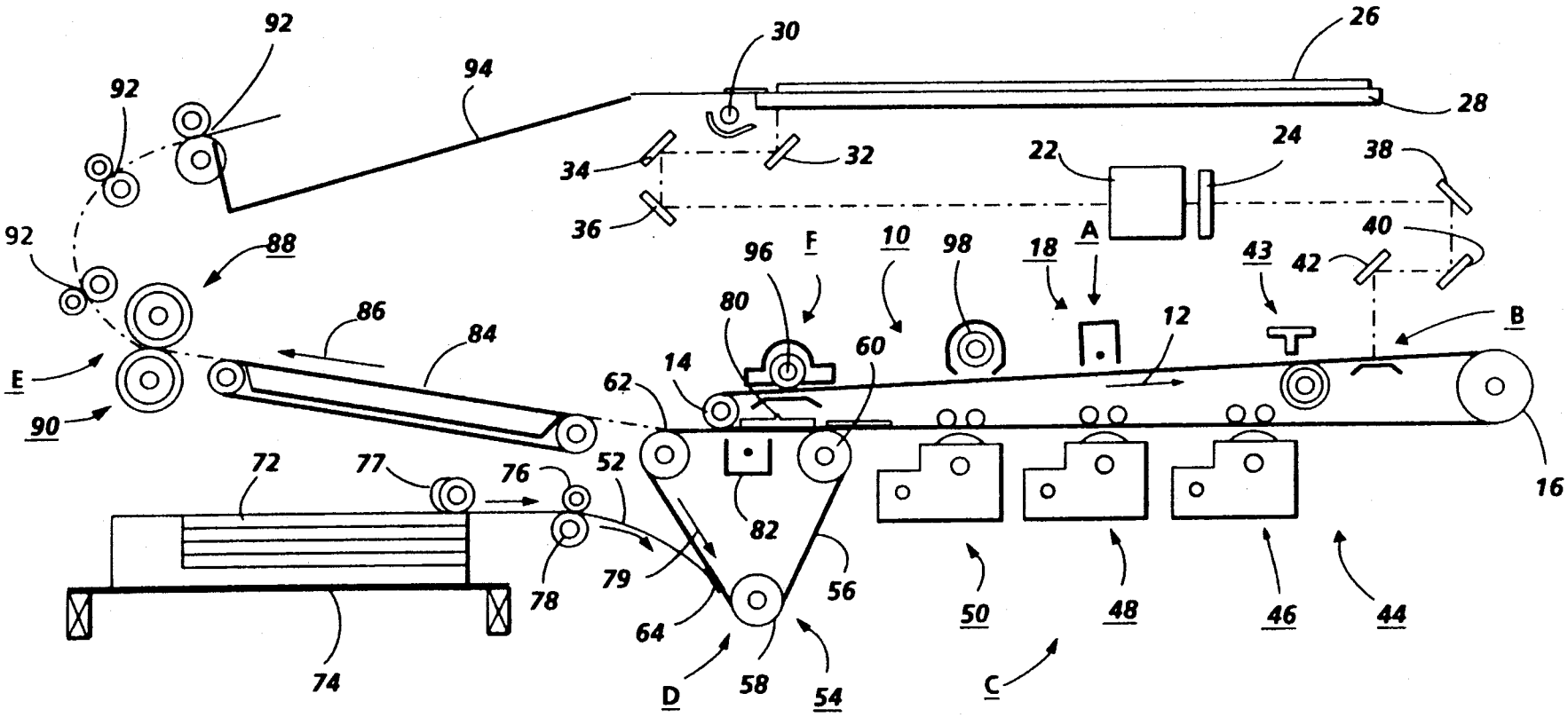
FIG. 1 is a partially schematic, elevational view of a printing apparatus including a fuser roll of the present invention.

While the present invention will hereinafter be described in connection with a preferred embodiment thereof, it will be understood that it is not intended to limit the invention to that embodiment. On the contrary, it is intended to cover all alternatives, modifications and equivalents as may be included within the spirit and scope of the invention as defined by the appended claims. For a general understanding of the features of the present invention, reference is made to the drawings. In the drawings, like reference numerals have been used throughout to designate identical elements. FIG. 1 schematically depicts the various components of an illustrative electrophotographic printing machine incorporating a toner concentration sensing apparatus of the present invention therein. It will become evident from the following discussion that the sensing apparatus of the present invention is equally well suited for use in a wide variety of electrostatographic printing machines, and is not necessarily limited in its application to the particular electrophotographic printing machine shown herein.

Inasmuch as the art of electrophotographic printing is well known, the various processing stations employed in the FIG. 1 printing machine will be shown hereinafter schematically and their operation described briefly with reference thereto.

As shown in FIG. 1, the electrophotographic printing machine employs a photoreceptor, i.e. a photoconductive belt 10. Preferably, the photoconductive belt 10 is made from a photoconductive material coated on a grounding layer, which, in turn, is coated on an anticurl backing layer. The photoconductive material is made from a transport layer coated on a generator layer. The transport layer transports positive charges from the generator layer. The interface layer is coated on the grounding layer. The transport layer contains small molecules of di-m-tolydiphenylbiphenyldiamine dispersed in a polycarbonate. The generation layer is made from trigonal selenium. The grounding layer is made from a titanium coated Mylar. The grounding layer is very thin and allows light to pass therethrough. Other suitable photoconductive materials, grounding layers, and anti-curl backing layers may also be employed. Belt 10 moves in the direction of arrow 12 to advance successive portions of the photoconductive surface sequentially through the various processing stations disposed about the path of movement thereof. Belt 10 is entrained about idler roller 14 and drive roller 16. Idle roller 14 is mounted rotatably so as to rotate with belt 10. Drive roller 16 is rotated by a motor coupled thereto by suitable means such as a belt drive. As roller 16 rotates, it advances belt 10 in the direction of arrow 12.

Initially, a portion of photoconductive belt 10 passes through charging station A. At charging station A, a corona generating device, indicated generally by the reference numeral 18 charges photoconductive belt 10 to a relatively high, substantially uniform potential.

Next, the charged photoconductive surface is rotated to exposure station B. Exposure station B includes a moving lens system, generally designated by the reference numeral 22, and a color filter mechanism, shown generally by the reference numeral 24. An original document 26 is supported stationarily upon a transparent viewing platen 28. Successive incremental areas of the original document are illuminated by means of a moving lamp assembly, shown generally by the reference numeral 30. Mirrors 32, 34 and 36 reflect the light rays through lens 22. Lens 22 is adapted to scan successive areas of illumination of platen 28. The light rays from lens 22 are transmitted through filter 24 and reflected by mirrors 38, 40, and 42 on to the charged portion of photoconductive belt 10. Lamp assembly 30, mirrors 32, 34 and 36, lens 22, and filter 24 are moved in a timed relationship with respect to the movement of photoconductive belt 10 to produce a flowing light image of the original document on photconductive belt 10 in a non-distorted manner. During exposure, filter mechanism 24 interposes selected color filters into the optical light path of lens 22. The color filters operate on the light rays passing through the lens to record an electrostatic latent image, i.e. a latent electrostatic charge pattern, on the photoconductive belt corresponding to a specific color of the flowing light image of the original document. Exposure station B also includes a test area generator, indicated generally by the reference numeral 43, comprising a light source to project a test light image onto the charged portion of the photoconductive surface in the inter-image region, i.e. the region between successive electrostatic latent images recorded on photoconductive belt 10, to record a test area. The test area, as well as the electrostatic latent image recorded on the photoconductive surface of belt 10 are developed with toner particles at a development station C.

After the electrostatic latent image and test area have been recorded on photoconductive belt 10, belt 10 advances them to the development station C. Development station C includes four individual developer units generally indicated by the reference numerals 44–47. The developer units are of a type generally referred to in the art as "magnetic brush development units." Typically, a magnetic brush development system employs a magnetizable developer material including magnetic carrier granules having marking or toner particles adhering triboelectrically thereto. The developer material is continually brought through a directional flux field to form a brush 48 of developer material. The developer particles are continually moving so as to provide the brush 48 consistently with fresh developer material. Development is achieved by bringing the brush 48 of developer material into contact with the photoconductive surface. Developer units 44–47, respectively apply marking or toner particles of a specific color which corresponds to the compliment of the specific color separated electrostatic latent image recorded on the photoconductive surface. The color of each of the marking or toner particles is adapted to absorb light within a preselected spectral region of the electromagnetic wave spectrum corresponding to the wave length of light transmitted through the filter. For example, an electrostatic latent image formed by passing the light image through a green filter will record the red and blue portions of the spectrums as areas of relatively high charge density on photoconductive belt 10, while the green light rays will pass through the filter and cause the charge density on the photoconductive belt 10 to be reduced to a voltage level ineffective for development. The charged areas are then made visible by having developer unit 44 apply green absorbing (magenta) toner particles onto the electrostatic latent image recorded on photoconductive belt 10. Similarly, a blue separation is developed by developer unit 45 with blue absorbing (yellow) toner particles, while the red separation is developed by developer unit 46 with red absorbing (cyan) toner particles. Developer unit 47 contains black toner particles and may be used to develop the electrostatic latent image formed from a black and white original document. The yellow, magenta and cyan toner particles are diffusely reflecting particles. Each of the developer units 44–47 is moved into and out of the operative position. In the operative position, the magenta brush 48 is closely adjacent the photoconductive belt, while, in the non-operative position, the magnetic brush 48 is spaced therefrom. During development of each electrostatic latent image only one developer unit is in the operative position, the remaining developer units are in the non-operative position. This insures that each electrostatic latent image and successive test areas are developed with toner particles of the appropriate color without co-mingling. In FIG. 1, developer unit 44 is shown in the operative position with developer units 45–47 being in the non-operative position.

After development, the toner image is moved to transfer station D where the toner image is transferred to a sheet of support material 52, such as plain paper amongst others. At transfer station D, the sheet transport apparatus, indicated generally by the reference numeral 54, moves sheet 52 into contact with photoconductive belt 10. Sheet transport 54 has a pair of spaced belts 56 entrained about the three rolls 58, 60 and 62. A gripper 64 extends between belts 56 and moves in unison therewith. Sheet 52 is advanced from a stack of sheets 72 disposed on tray 74. Feed roll 77 advances the uppermost sheet from stack 72 into the nip defined by forwarding rollers 76 and 78. Forwarding rollers 76 and 78 advance sheet 52 to sheet transport 54. Sheet 52 is advanced by forwarding rollers 76 and 78 in synchronism with the movement of gripper 64. In this way, the leading edge of sheet 52 arrives at a preselected position to be received by the open gripper 64. The gripper 64 then closes, securing the sheet thereto for movement therewith in a recirculating path. The leading edge of the sheet is secured releasably of gripper 64. As the belts move in the direction of arrow 79, the sheet 52 moves into contact with the photoconductive belt, in synchronism with the toner image developed thereon, at a transfer zone 80. A corona generating device 82 sprays ions onto the backside of the sheet so as to charge the sheet to the proper magnitude and polarity for attracting the toner image from photoconductive belt 10 thereto. Sheet 52 remains secured to gripper 64 so as to move in a recirculating path for three cycles. In this way, three different color toner images are transferred to sheet 52 in superimposed registration with one another. Thus, the aforementioned steps of charging, exposing, developing, and transferring are repeated a plurality of cycles to form a multi-color copy of a colored original document.

After the last transfer operation, grippers 64 open and release sheet 52. Conveyor 84 transport sheet 52, in the direction of arrow 86, to fusing station E where the transferred image is permanently fused to sheet 52. Fusing station E includes a heated fuser roll 88 and a pressure roll 90. Sheet 52 passes through the nip defined by fuser roll 88 and pressure roll 90. The toner image contacts fuser roll 88 so as to be affixed to sheet 52. Thereafter, sheet 52 is advanced by forwarding roll pairs 92 to catch tray 94 for subsequent removal therefrom by the machine operator.

The last processing station in the direction of movement of belt 10, as indicated by arrow 12, is cleaning station F. A rotatably mounted fibrous brush 96 is positioned in cleaning station F and maintained in contact with photoconductive belt 10 to remove residual toner particles remaining after the transfer opreation. Thereafter, lamp 98 illuminates photoconductive belt 10 to remove any residual charge remaining thereon prior to the start of the next successive cycle.

Figure 2:
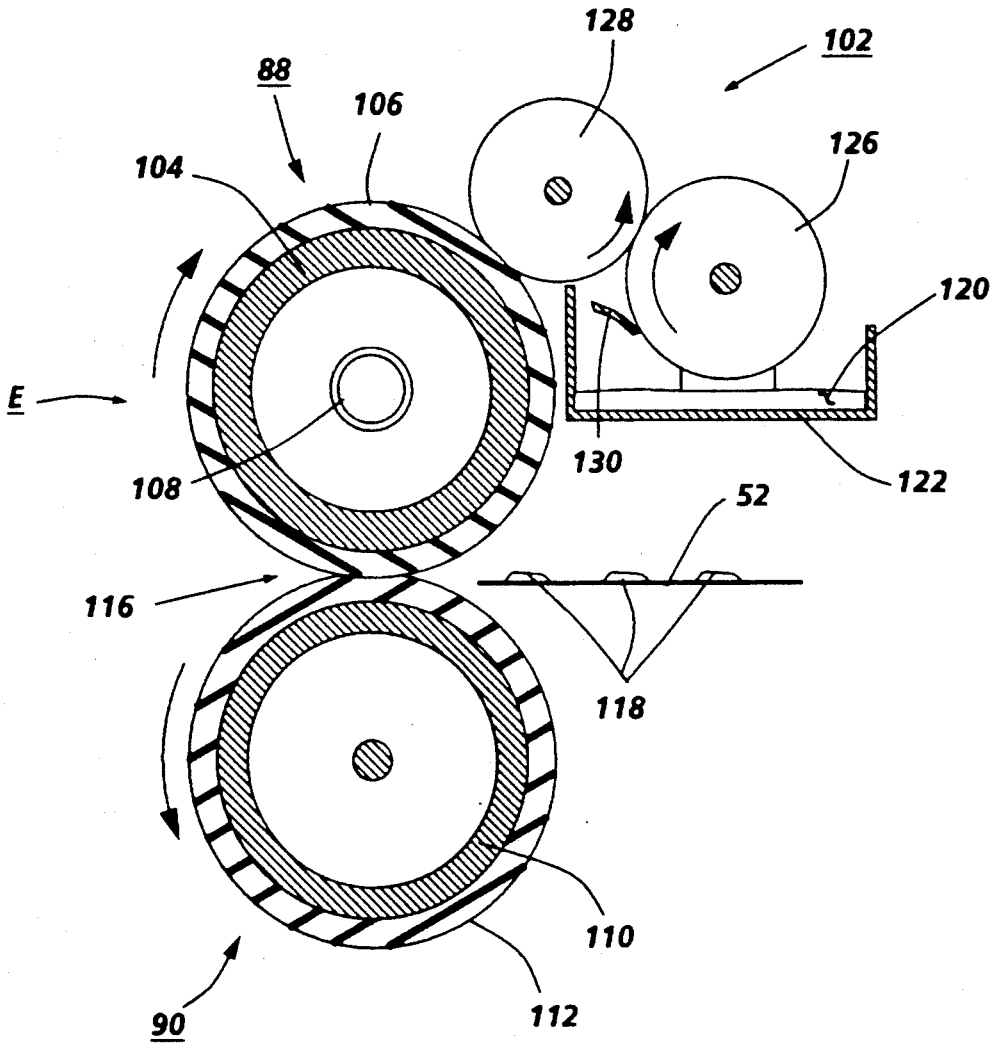
FIG. 2 a partially schematic, elevational view of a fusing apparatus adapted for use in the printing apparatus of FIG. 1.

Referring now to FIG. 2 the fusing station E is shown in further detail. In the illustrated embodiment of FIG. 3, the fuser roll 88 and pressure roll 90 are illustrated together with a release agent management (RAM) system 102. Preferably, the fuser roll 88 includes a core or roller member 104, the core 104 having thereon a layer or layers 106 of a suitable elastomer. The core 104 may be made of various metals such as iron, aluminum, nickel, stainless steel, etc., and various synthetic resins. Aluminum is preferred as the material for the core 104, although this is not critical. The core 104 is hollow and a heating element 108 is generally positioned inside the hollow core 104 to supply the heat for the fusing operation. Heating elements suitable for this purpose are known in the prior art and may comprise a quartz heater made of a quartz envelope having a tungsten resistance heating element disposed internally thereof. The method of providing the necessary heat is not critical to the present invention, and the fuser roll 88 can be heated by internal means, external means or a combination of both. Heating means are well known in the art for providing sufficient heat to fuse the toner to the support. The fusing elastomer layer 106 may be made of any of the well known materials such as the Viton and/or silicone rubber.

The fuser roll 88 is shown in a pressure contact arrangement with the backup or pressure roll 90. The pressure roll 90 comprises a metal core 110 with an outer layer 112 of a heat-resistant material. In this assembly, both the fuser roll 88 and the pressure roll 90 are mounted on bearings 114 (FIGS. 3 or 4), which bearings 114 are biased so that the fuser roll 88 and pressure roll 90 are pressed against each other under sufficient pressure to form a nip 116. It is in this nip 116 that the fusing or fixing action takes place. The layer 112 may be made of any of the well known materials such as Teflon a trademark of E.I. DuPont.

The image receiving member or final support 52 having toner images 118 thereon is moved through the nip 116 with the toner images 118 contacting the heated fuser roll 88. The toner material forming the image 118 is prevented from offsetting to the surface of the fuser roll 88 through the application of a release agent material such as silicone oil 120 contained in sump 122.

The sump 122 and silicone oil 120 form part of the RAM system 102. The RAM system 102, according to one embodiment of the invention further comprises a metering roll 126 and a donor roll 128. The metering roll 126 is supported partially immersed in the silicone oil 120 and contacts the donor roll 128 for conveying silicone oil 120 from the sump 122 to the surface of the donor roll 128. The donor roll 128 is rotatably supported in contact with the metering roll 126 and also in contact with the fuser roll 88. While the donor roll 128 is illustrated as contacting the fuser roll 88, it will be appreciated that, alternately, the donor roll 128 could contact the pressure roll 90. Also, the positions of the fuser roll 88 and the pressure roll 90 could be reversed for use in other printing apparatuses. A metering blade 130 supported in contact with the metering roll 120 serves to meter silicone oil 120 to the required thickness on the metering roll 126.

Figure 3:
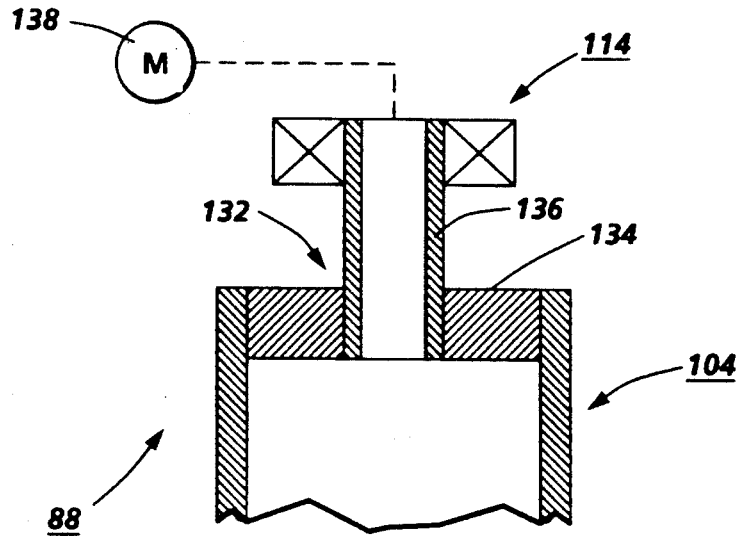
FIG. 3 is a partially schematic, sectional view of one preferred embodiment of the fuser roll of the present invention.

Referring to FIG. 3, one preferred embodiment of the fuser roll 88 is shown. The fuser roll 88 of FIG. 3 comprises the core 104 operatively coupled to a journal member 132, the journal member 132 including a base 134 in which a shaft 136 is embedded. In one example, the base 134 is comprised of cast aluminum while the shaft 136 is comprised of stainless steel. Even though the composition of the materials used to construct the base 134 and the shaft 136 is not critical, it is preferred that at least peripheral portions of the base 134 include material similar to that used to construct the core 104. The shaft 136 can be molded into a cooled molten aluminum base 134, or coupled with the base 134 by way of a pressure or screw fitting. As shown in FIG. 3, the shaft 136 is rotatably mounted in the bearing 114 for rotation thereof with a conventional motor 138.

In the preferred form of manufacturing for the fuser roll 88, the shaft 136 is embedded in the base 134, and the periphery of the base 134 is spot welded to an inner surface of the core 104. It will be appreciated by those skilled in the art that when the periphery of the base 134 includes material that is similar to that of the core 104, welded coupling between the core 104 and the base 134 is readily achieved. Moreover, in the preferred embodiment, the shaft 136 has a thermal conductivity that is substantially less than that of the core 104 or the base 134, so that when the fuser roll 88 is heated with the heating element 108, more heat is distributed per unit area of the core 104 and the base 134 than per unit area of the shaft 136. When relatively less heat is dissipated at the bearings 114, as is the case for the above described fuser 88, the useful life of the bearings 114 is prolonged advantageously.

Figure 4:
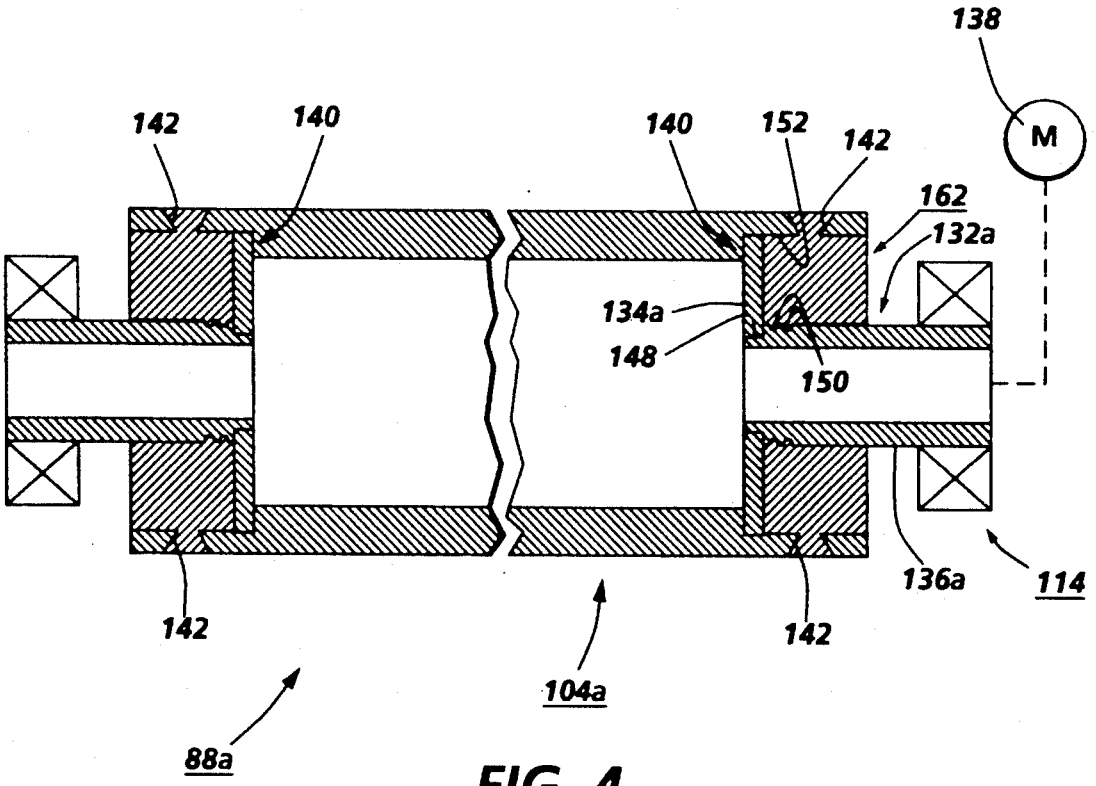
FIG. 4 is a partially schematic, sectional view of another preferred embodiment of the fuser roll of the present invention.

Referring to FIG. 4, another preferred embodiment of the fuser roll 88 is designated by the numerals 88*a*. Each component of fuser roll 88*a* that represents a modified component of fuser roll 88 will be designated with the same numeral as that used for the corresponding component of fuser 88, except that the suffix "a" will be added to the modified component. The core 104*a* differs from the core 104 in two significant respects. First, base support means 140 are defined near end portions of the roller member 104*a*. In one example, each base support means 140 is a shoulder defined by edges cut into an inner wall of the roller member 104*a* near opposing ends thereof. It is contemplated that equivalents to the shoulders 140 could be employed to support bases 134*a* without deviating from the concept of the present invention. For example, each base support means 140 could comprises a snap ring secured in a groove of the inner wall of the roller member.

Second, apertures 142 are disposed in the inner wall of the core 104*a* near opposing ends thereof. Journal members 132*a* are secured with the core 104*a*, as described below. Each journal member 132*a* comprises a shaft 136*a* and a base 134*a*, the base 134*a*, defining an aperture 148 for receiving the shaft 136*a*. In one example, threads 150 are formed on the shaft 136*a* and the shaft 136*a* is fitted threadingly into the aperture 148. In other contemplated examples, the shaft 136*a* could be pressure-fitted to or mounted conventionally with the base 134*a*. When one of the bases 134*a* is positioned adjacent one of the shoulders 140, cavity 152 is formed between the journal member 132*a* and the inner wall of the core 104*a*.

Figure 5A:
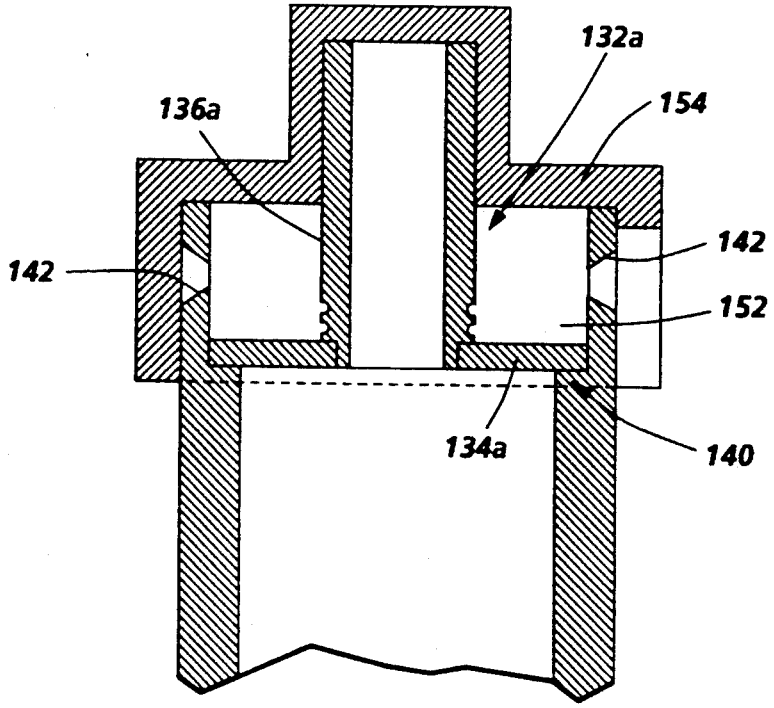
FIG. 5A is a partially schematic, sectional view of the fuser roll of FIG. 4 with a mold secured to an end portion thereof.
Figure 5B:
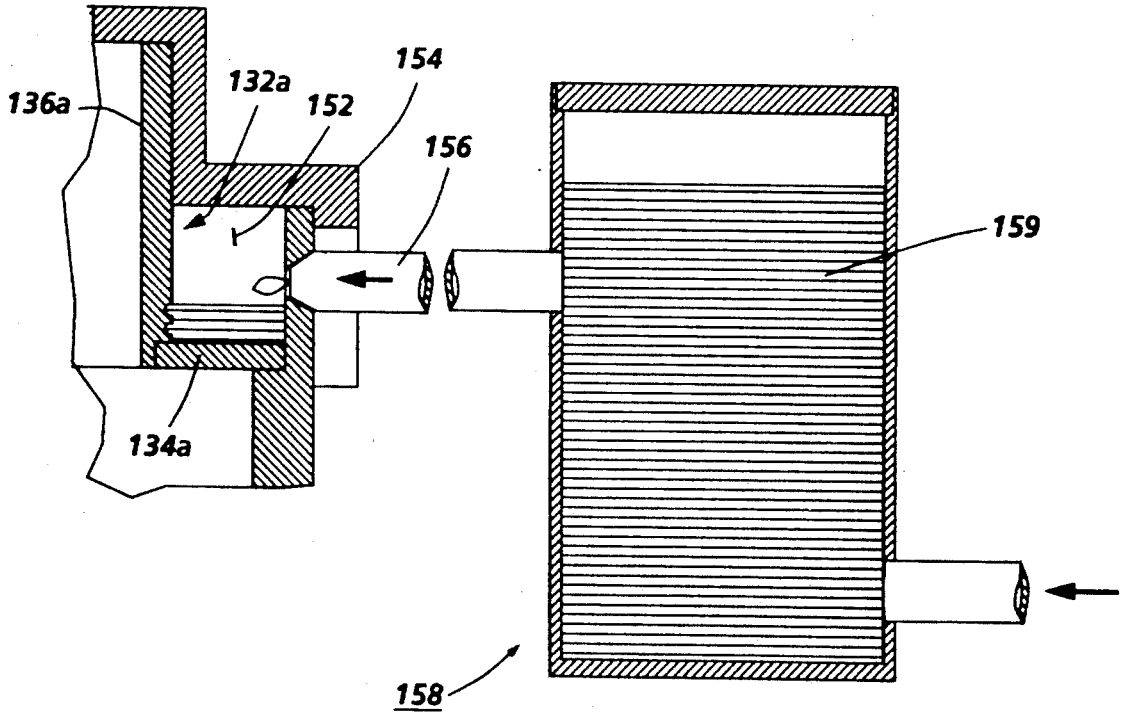
FIG. 5B is a schematic, sectional view of an arrangement used to inject molten metal into a cavity defined in the end portion of the fuser roll.

Referring to FIGS. 4, 5A and 5B, a method of securing the journal member 132 with core 104*a* is explained in further detail. Since the journal members 132*a* are secured to the core 104*a* in the same manner, only the method for securing one of the journal members 132*a* is shown. In the illustrated embodiment of FIG. 5A, and end of the roller member 104*a* is placed into a mold 154, the mold 154 constraining the level of molten metal at the open end of the cavity 152 and all of the apertures 142, except for the aperture 142 into which the molten metal is to be injected. Referring specifically to FIG. 5B, a metered amount of molten metal, such as molten aluminum, is injected into the cavity 152, through the unconstrained aperture 142, with a nozzle or tube 156. In one example, the source of the injected molten metal is a reservoir 158 containing a pressurized quantity of molten metal 159. After the cavity 152 is filled with the molten metal, the nozzle 162 is maintained adjacent the unconstrained aperture 142 to retain the molten metal in the trough 152. When a suitable cooling period has elapsed, the tube or nozzle 156 is retracted. As will be appreciated by those skilled in the art, in another example of manufacture, more than one of apertures 142 could be used as an injection port. Moreover, in yet another example, the apertures 142 could be constrained while the molten metal is poured in through the open end of the trough 152.

Referring again to FIG. 4, the cooled molten metal forms a metal plug 162 which is trapped or "pinned" in the cavity 152 by the cooled molten metal of the apertures 142. That is, the metal in the apertures 142 serve as "dowel pins" that hold the plug securely in the trough 152. Moreover, the threads 150 further serve to anchor the plug 162 in the trough 152.

It should be appreciated that each of the fuser roll 88 and 88*a* possess a durable construction that is readily manufactured. For example, experimentation indicates that the respective connections between journal members 88, 88*a* and core members 104, 104*a* are not readily distorted upon being subjected to relatively high torsional forces. While the fuser roll 88 is well suited for its intended purpose, it can be recognized that the fuser roll 88 is well suited for its intended purpose, it can be recognized that the fuser roll 88*a* has a distinct advantage over the fuser roll 88 in that base 134*a* need not be welded to the rolling member 104*a*. Consequently, in the manufacturing of fuser rolls 88, 88*a*, the fuser roll 88*a* is subjected to less heat stress than is the fuser roll 88.

What is claimed is:

1. An apparatus for fusing marking particles onto a support member, comprising:

a journal member including a shaft and a base, said shaft being coupled with said base;

a roller member having opposing ends, said roller member including means for supporting said journal member near an end of said roller member.

means separate from said roller member, for retaining a portion of said base immediately adjacent said supporting means so that the portion of said base touches said means for supporting and said shaft moves in substantial unison with said roller member; and means for heating said roller member to fuse the marking particles onto the support member when the support member with marking particles is brought into contact with said rolling member.

2. The fusing apparatus of claim 1, wherein each of said shaft and said roller member is thermally conductive, and wherein the thermal conductivity of said shaft is substantially less than the thermal conductivity of said roller member.

3. The fusing apparatus of claim 2, wherein said roller member comprises aluminum and said shaft comprises stainless steel.

4. The fusing apparatus of claim 1, further comprising a second roller member disposed adjacent said first roller member, said second roller member cooperating with said first roller member to form a nip through which the support member can pass.

5. An apparatus for fusing marking particles onto a support member, comprising:

a journal member including a shaft and a base, said shaft being coupled with said base;

a roller member having opposing ends, said roller member including means for supporting said journal member near an end of said roller member, wherein:

said roller member comprises a hollow cylindrical tube having opposing open ends, said supporting means is defined by a shoulder formed along an inner wall of said cylinder, said journal member and said hollow cylindrical tube form a cavity therebetween, and a metal plug is disposed in said cavity;

means for retaining said base adjacent said supporting means so that at least a portion of said base is in substantial contact with said means for supporting; and means for heating said roller member to fuse the marking particles onto the support member when the support member with marking particles is brought into contact with said rolling member.

6. The fusing apparatus of claim 5, wherein said hollow cylindrical tube defines an aperture, said aperture being in communication with said cavity.

7. The fusing apparatus of claim 6, wherein said aperture, when viewed in cross-section, is substantially frusto-conical.

8. In a printing apparatus of the type having means for fusing marking particles disposed on a support member thereto, the improvement comprising:

a journal member including a shaft and a base, said shaft being coupled with said base;

a roller member having opposing ends, said roller member including means for supporting said journal member near an end of said roller member; and means, separate from said roller member, for retaining a portion of said base immediately adjacent said supporting means so that the portion of said base touches said means for supporting and said shaft moves in substantial unison with said roller member.

9. The printing apparatus of claim 8, wherein each of said shaft and said roller member is thermally conductive, and wherein the thermal conductivity of said shaft is substantially less than the thermal conductivity of said roller member.

10. The printing apparatus of claim 9, wherein said roller member comprises aluminum and said shaft comprises steel.

11. The printing apparatus of claim 8, further comprising a second roller member disposed adjacent said first roller member, said second roller member cooperating with said first roller member to form a nip through which the support member can pass 12. In a printing apparatus of the type having means for fusing marking particles disposed on a support member thereto, the improvement comprising:

a journal member including a shaft and a base, said shaft being coupled with said base;

a roller member having opposing ends, said roller member including means for supporting said journal member near an end of said roller member, wherein:

said roller member comprises a hollow cylindrical tube having opposing open ends, said supporting means is defined by a shoulder formed along an inner wall of said cylinder, said journal member and said hollow cylindrical tube form a cavity therebetween, and a metal plug is disposed in said cavity; and means for retaining said base adjacent said supporting means so that at least a portion of said base is in substantial contact with said means for supporting. a metal plug is disposed in said cavity.

13. The apparatus of claim 12, wherein said hollow cylindrical tube defines an aperture, said aperture being in communication with said cavity.

14. The printing apparatus of claim 13, wherein said aperture, when viewed in cross-section, is substantially frusto-conical.

15. An apparatus for fusing marking particles onto a support member, comprising:

a tubular member having opposing ends and comprising a first material;

a journal member including a shaft and a base, said shaft comprising a second material, said base comprising at least a quantity of the first material along an outer periphery thereof, said shaft being coupled with said base;

means for securing the outer periphery of said base to an inner surface of said tubular member, wherein a secure bond is formed between the first material of the inner surface of said tubular member and the first material of the periphery of said base; and means for heating said tubular member to fuse the marking particles onto the support member when the support member with marking particles is brought into contact with said rolling member.

16. The fusing apparatus of claim 15, wherein said means for securing comprises welds between the inner surface of said tubular member and the periphery of said base.

17. The fusing apparatus of claim 15, wherein said base substantially comprises the first material, and wherein a portion of said shaft is embedded within said base.

18. The fusing apparatus of claim 15, wherein each of the first and second materials is thermally conductive, and wherein the thermal conductivity of the second material is substantially less than the thermal conductivity of the first material.

19. The fusing apparatus of claim 18, wherein the first material comprises aluminum and the second material comprises steel.

20. The fusing apparatus of claim 15, further comprising a roller member disposed adjacent said tubular member, said roller member cooperating with said tubular member to form a nip through which the support member can pass.

21. In a printing apparatus of the type having means for fusing marking particles disposed on a support member thereto, the improvement comprising:

a tubuler member having opposing ends and comprising a first material;

a journal member including a shaft and a base, said shaft comprising a second material, said base comprising at least a quantity of the first material along an outer periphery thereof, said shaft being coupled with said base; and means for securing the outer periphery of said base to an inner surface of said tubular member, wherein a secure bond is formed between the first material of the tubular member and the first material of the periphery of said base.

22. The printing apparatus of claim 21, wherein said means for securing comprises welds between the inner surface of said tubular member and the periphery of said base.

23. The printing apparatus of claim 21, wherein said base substantially comprises the first material, and wherein a portion of said shaft is embedded within said base.

24. The printing apparatus of claim 21, wherein each of the first and second materials is thermally conductive, and wherein the thermal conductivity of the second material is substantially less than the thermal conductivity of the first material.

25. The printing apparatus of claim 24, wherein the first material comprises aluminum and the second material comprises steel.

26. The printing apparatus of claim 21, further comprising a roller member disposed adjacent said tubular member, said roller member cooperating with said tubular member to form a nip through which the support member can pass.

27. A method for manufacturing a fusing apparatus adapted for use in an apparatus for fusing marking particles to a support member, the fusing apparatus including a journal member, the journal member including a shaft and a base, the shaft being coupled with the base, the fusing apparatus further including a roller member having opposite ends, the roller member including means for supporting the base near an opposing end of the roller member, the method for manufacturing comprising the steps of:

disposing the base of the journal member adjacent the shoulder of the roller member so that the base abuts the supporting means while the journal member and the roller member form a cavity therebetween;

filling at least a part of the cavity with molten metal wherein a portion of the shaft is encompassed by the molten metal; and cooling the molten metal so that the journal member is operatively coupled to the roller member and the journal member can be rotated in unison with the roller member.

28. The method of claim 27, wherein the roller member defines at least one aperture communicating with the cavity, and wherein the filling step comprises the step of injecting the molten metal into the cavity by way of the aperture.

29. The method of claim 28, further comprising the step of configuring the aperture to possess a frusto-conical cross-section so that when the cavity and aperture are filled with molten metal and the molten metal is cooled, the cooled molten metal in the cavity is "pinned" by the cooled molten metal in the aperture.

30. The method of claim 27, further comprising the step of providing the shaft with a first thermal conductivity and the roller member with a second conductivity, wherein the first thermal conductivity is substantially less than the second thermal conductivity.

* * * * *